US009892873B2

(12) United States Patent
Malingowski et al.

(10) Patent No.: US 9,892,873 B2
(45) **Date of Patent: *Feb. 13, 2018**

(54) MULTI-PURPOSE MOUNTING FOR AN ELECTRICAL SWITCHING APPARATUS

(71) Applicant: Eaton Corporation, Cleveland, OH (US)

(72) Inventors: Richard Paul Malingowski, McDonald, PA (US); James Patrick Sisley, Baden, PA (US); Mark Anthony Janusek, Bethel Park, PA (US)

(73) Assignee: Eaton Corporation, Cleveland, OH (US)

( * ) Notice: Subject to any disclaimer, the term of this patent is extended or adjusted under 35 U.S.C. 154(b) by 48 days.

This patent is subject to a terminal disclaimer.

(21) Appl. No.: 15/232,890

(22) Filed: Aug. 10, 2016

(65) Prior Publication Data

US 2016/0351354 A1 Dec. 1, 2016

Related U.S. Application Data

(63) Continuation of application No. 14/250,408, filed on Apr. 11, 2014, now Pat. No. 9,443,669.

(51) Int. Cl.

| | |
|---|---|
| ***H01H 1/64*** | (2006.01) |
| ***H01H 9/02*** | (2006.01) |
| ***H01H 71/02*** | (2006.01) |
| ***H01H 71/24*** | (2006.01) |
| ***H01H 71/46*** | (2006.01) |
| ***H01H 1/14*** | (2006.01) |
| ***H01H 13/14*** | (2006.01) |

(52) U.S. Cl.

CPC ..... *H01H 9/02* (2013.01); *H01H 1/14* (2013.01); *H01H 13/14* (2013.01); *H01H 71/0228* (2013.01); *H01H 71/2463* (2013.01); *H01H 71/465* (2013.01); *H01H 2235/01* (2013.01)

(58) Field of Classification Search

CPC ..... H01H 9/02; H01H 13/14; H01H 1/14; H01H 2235/01

USPC ..... 200/293, 297, 307; 335/132, 202

See application file for complete search history.

(56) References Cited

U.S. PATENT DOCUMENTS

| | | | |
|---|---|---|---|
| 4,742,321 | A | 5/1988 | Nagy et al. |
| 4,794,356 | A | 12/1988 | Yu et al. |
| 4,939,490 | A | 7/1990 | Bernier et al. |

(Continued)

FOREIGN PATENT DOCUMENTS

| | | | |
|---|---|---|---|
| EP | 1098344 | A2 | 5/2001 |

*Primary Examiner* — Renee Luebke
*Assistant Examiner* — Lheiren Mae A Caroc
(74) *Attorney, Agent, or Firm* — Eckert Seamans; David Jenkins; Grant Coffield

(57) ABSTRACT

A multi-purpose mounting assembly is provided. The multi-purpose mounting assembly is structured to be disposed in an electrical switching apparatus housing assembly. The multi-purpose mounting assembly includes a body defining a first mounting assembly and a second mounting assembly. The first mounting assembly includes a first mounting construct. The second mounting assembly includes a second mounting construct. The first mounting construct is structured to support a first electrical component. The second mounting construct is structured to support a second electrical component.

16 Claims, 7 Drawing Sheets

(56) References Cited

U.S. PATENT DOCUMENTS

| | | | | |
|---|---|---|---|---|
| 5,341,191 | A | 8/1994 | Crookston et al. | |
| 5,343,179 | A * | 8/1994 | Pipich | H01H 71/2463 335/167 |
| 6,441,708 | B1 | 8/2002 | Rodriguez et al. | |
| 6,833,517 | B2 * | 12/2004 | Sotome | H01H 21/22 200/18 |
| 7,710,694 | B2 | 5/2010 | Asano et al. | |
| 7,843,291 | B2 | 11/2010 | Titus | |
| 9,443,669 | B2 * | 9/2016 | Malingowski | H01H 9/02 |
| 2007/0012550 | A1 * | 1/2007 | Wohlfart | H01H 3/122 200/18 |
| 2007/0205852 | A1 * | 9/2007 | Helms | H01H 71/2463 335/172 |
| 2015/0041290 | A1 | 2/2015 | Sisley et al. | |
| 2015/0170862 | A1 | 6/2015 | Carlino et al. | |

* cited by examiner

MULTI-PURPOSE MOUNTING FOR AN ELECTRICAL SWITCHING APPARATUS

CROSS REFERENCE TO RELATED APPLICATION

This application is a continuation application of and claims priority to U.S. patent application Ser. No. 14/250,408, filed Apr. 11, 2014 entitled, MULTI-PURPOSE MOUNTING FOR AN ELECTRICAL SWITCHING APPARATUS.

BACKGROUND OF THE INVENTION

Field of the Invention

This invention relates generally to electrical switching apparatus and, more particularly, to a multi-purpose mounting disposed in an electrical switching apparatus housing apparatus.

Background Information

Electrical switching apparatus include, for example, circuit switching devices, circuit interrupters, such as circuit breakers, network protectors, contactors, motor starters, motor controllers, and other load controllers. Electrical switching apparatus such as circuit interrupters and, in particular, circuit breakers of the molded case variety, are well known in the art. See, for example, U.S. Pat. No. 5,341,191. Circuit breakers are used to protect electrical circuitry from damage due to an over-current condition, such as an overload condition or a relatively high level short circuit or fault condition. Molded case circuit breakers typically include a pair of separable contacts per phase. The separable contacts may be operated either manually by way of a handle disposed on the outside of the case, or housing assembly, or automatically in response to an over-current condition.

In an exemplary embodiment, circuit breakers include an operating mechanism, which is designed to rapidly open and close the separable contacts, a trip unit assembly, which senses over-current conditions, and a trip actuator assembly. The trip actuator is actuated by the trip unit assembly in response to an overcurrent condition and moves the operating mechanism to a trip state. In the trip state the separable contacts move to their open position.

Trip unit assemblies have often included mechanical devices that react magnetically or thermally to over-current conditions. Presently, electric circuits are also used to detect an over-current condition. As electric circuits do not react magnetically or thermally to over-current conditions, the electric circuit must be coupled to an electronic trip mechanism. For example, an electronic trip mechanism may be, without limitation, a flux shunt trip actuator. An electronic trip mechanism, such as, but not limited to, a flux shunt trip actuator needs a reset device. It is known to provide a separate reset actuator for a flux shunt trip actuator. That is, the reset actuator is separate from other elements such as, but not limited to, the circuit breaker handle.

Further, users include internal accessories in the molded case such as, but not limited to, an auxiliary switch. The auxiliary switch is, in an exemplary embodiment, a microswitch disposed in a housing such as, but not limited to, an electrical peripheral circuit; e.g., a device that senses the state of the breaker contacts—on or off.

The molded case is, in many instances, generally divided into channel-like internal cavities with a conductor assembly for each pole extending through each cavity. The cavities further provide a space for additional components such as, but not limited to, the flux shunt trip actuator and the auxiliary switch. Such additional components are disposed in a mounting assembly that is further disposed in a molded case cavity. The space inside the molded case is, however, limited. Generally, mounting assemblies are structured to support a single type of additional component. Thus, if a user includes a flux shunt trip actuator, the user is precluded from including an auxiliary switch due to a lack of space for an auxiliary switch mounting assembly.

There is, therefore, room for improvement in electrical switching apparatus, such as circuit breakers, and in mounting assemblies structured to be disposed in an electrical switching apparatus housing assembly.

SUMMARY OF THE INVENTION

At least one embodiment of this invention provides for a multi-purpose mounting assembly structured to be disposed in an electrical switching apparatus housing assembly. The multi-purpose mounting assembly includes a body defining a first mounting assembly and a second mounting assembly. The first mounting assembly includes a first mounting construct. The second mounting assembly includes a second mounting construct. The first mounting construct is structured to support a first electrical component. The second mounting construct is structured to support a second electrical component.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
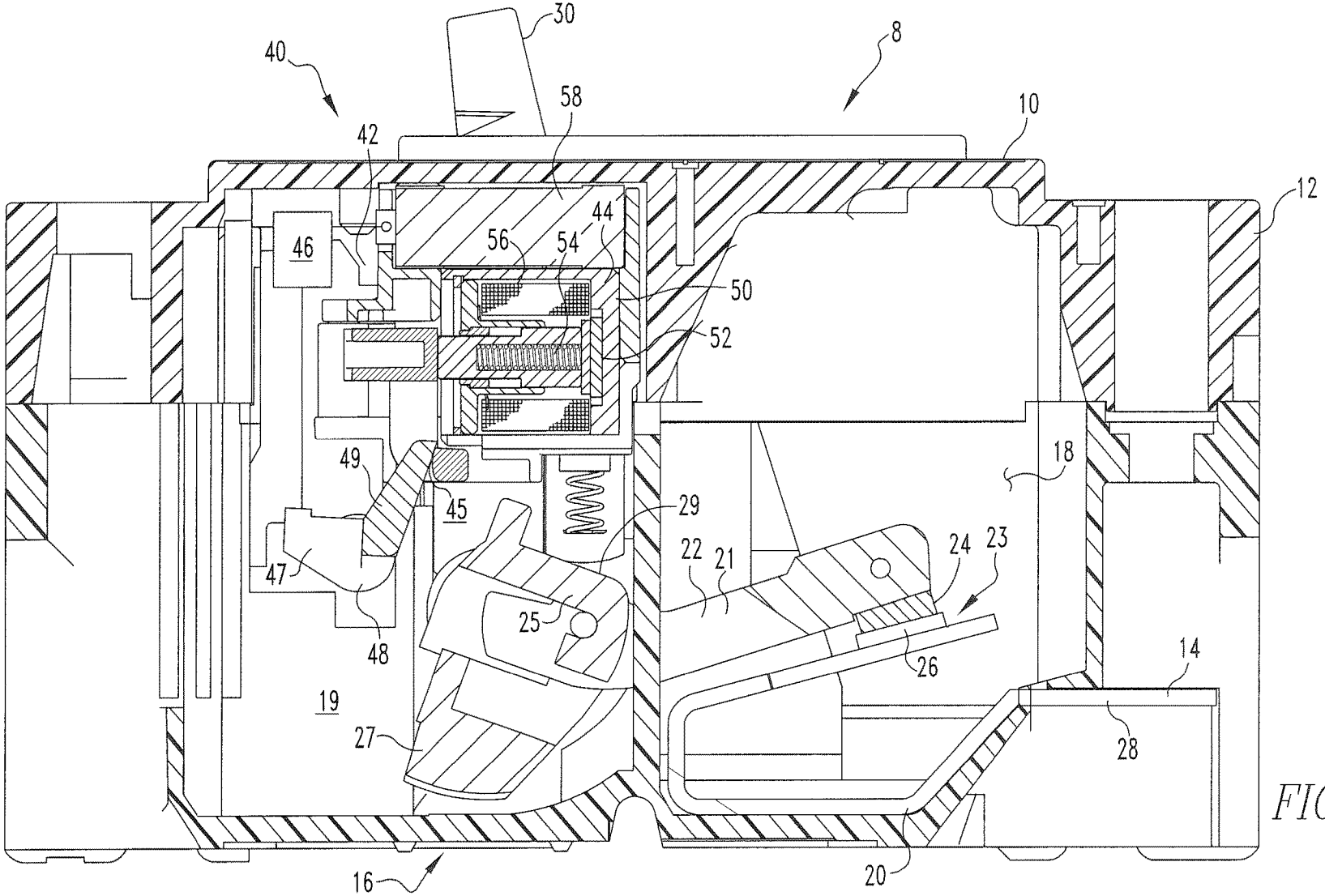
FIG. 1 is a cross-sectional side view of an electrical switching apparatus.
Figure 2:
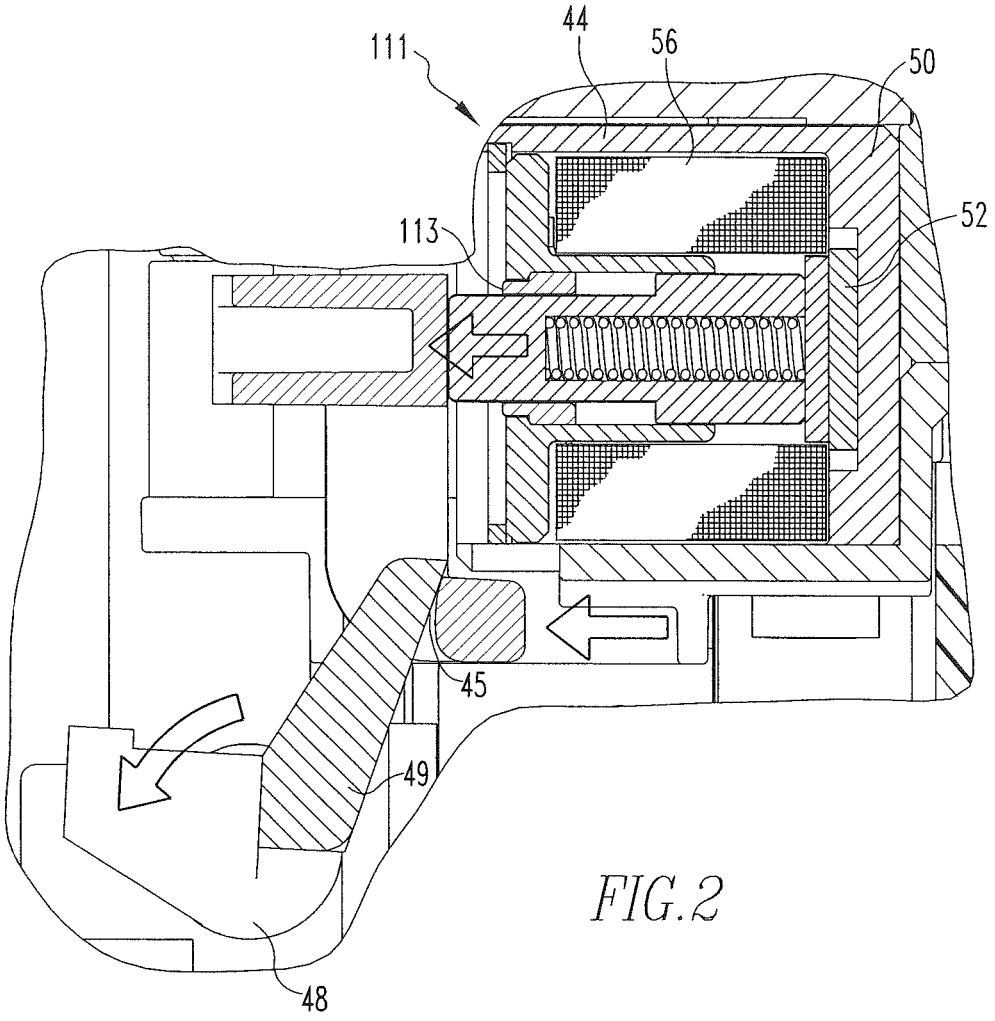
FIG. 2 is a detail cross-sectional side view of a trip and reset assembly.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "actuator" and "actuating element" mean any known or suitable output mechanism (e.g., without limitation, trip actuator, solenoid, a flux shunt trip actuator) for an electrical switching apparatus and/or the element (e.g., without limitation, stem; plunger; lever; paddle; arm) of such mechanism which moves in order to manipulate another component of the electrical switching apparatus.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof.

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A engages element B while in element A first position.

As used herein, the word "unitary" means a component is created as a single piece or unit. That is, a component that includes pieces that are created separately and then coupled together as a unit is not a "unitary" component or body.

As used herein, the term "number" shall mean one or an integer greater than one a plurality).

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, a magnet "operatively spaced" from another element capable of magnetic attraction means that the two elements are so close as to allow the magnet to be attracted to the other element with a sufficient force so that, if the magnet or other element is not restrained, the magnet or other element would move into contact with each other.

As used herein, a "cam surface" is a surface that engages, or is engaged by, another member and wherein a member moves in response to the engagement. A surface that is merely capable of engaging, or being engaged by, another element but does not actually engage the other element in a manner that causes an intended movement is not a "cam surface."

As used herein, "associated" means that the elements are part of the same assembly and/or, operate together, or, act upon/with each other in some manner. For example, an automobile has four tires and four hub caps. While all the elements are coupled as part of the automobile, it is understood that each hubcap is "associated" with a specific tire.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snuggly correspond." In that situation, the difference between the size of the components is even smaller whereby the amount of friction increases. If the element defining the opening and/or the component inserted into the opening is made from a deformable or compressible material, the opening may even be slightly smaller than the component being inserted into the opening. This definition is further modified if the two components are said to "substantially correspond." "Substantially correspond" means that the size of the opening is very close to the size of the element inserted therein; that is, not so close as to cause substantial friction, as with a snug fit, but with more contact and friction than a "corresponding fit," i.e., a "slightly larger" fit.

As used herein, a "first position" or "first configuration" is associated with an electrical switching apparatus in an open configuration, i.e., wherein electricity cannot pass through the electrical switching apparatus. Conversely, a "second position" or "second configuration" is associated with an electrical switching apparatus in a closed configuration, i.e., wherein electricity passes through the electrical switching apparatus. Thus, the "second position" or "second configuration" is associated with the operational state of the switching apparatus. Accordingly, it is understood that when describing the operation of the switching apparatus, e.g., tripping in response to an over-current condition, the switching apparatus, or elements and assemblies thereof, may start in the "second position" and move to the "first position."

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true. For example, a trip bar may be "operatively coupled"

to a circuit breaker operating mechanism, meaning that when the trip bar moves, so does the operating mechanism, but, the operating mechanism may not be "operatively coupled" to the trip bar, meaning that the operating mechanism may be manually operated, e.g., by a handle, without necessarily moving the trip bar.

As used herein, "generally curvilinear" includes elements having multiple curved portions, combinations of curved portions and planar portions, and a plurality of planar portions or segments disposed at angles relative to each other thereby forming a curve.

As used herein, a "multi-purpose mounting assembly" is a mounting assembly that is structured to support more than one electrical component.

As shown in FIG. 1, an electrical switching apparatus 8, such as, but not limited to a circuit breaker 10, includes an electrical switching apparatus housing assembly 12, a conductor assembly 14, an operating mechanism 16, a trip unit assembly 40, (elements shown schematically) as well as other components. The electrical switching apparatus housing assembly 12 is made from a non-conductive material and defines an enclosed space 18 wherein the other components may be disposed. The electrical switching apparatus housing assembly enclosed space 18 is, in an exemplary embodiment, divided into a number of cavities 19 including a cavity 19 for a trip unit assembly actuator 44, described below. Three elongated cavities 19A, 19B, 19C generally extend the length of the housing assembly 12 and are each structured to substantially enclose the elements of one pole of the conductor assembly 14. Each of the elongated cavities 19A, 19B, 19C have a width.

The conductor assembly 14 includes a number of conductive elements 20 that extend through the electrical switching apparatus housing assembly 12. That is, a number of conductive elements 20 include, but are not limited to, a line bus 22, a pair of contacts 23 including a movable contact 24 and a fixed contact 6, and aloud bus 28. As is known, there may be a number of sets of these elements, however, only one set will be described below. The line bus 22 and movable contact 24 are in electrical communication. The fixed contact 26 and the load bus 28 are in electrical communication. Each movable contact 24 is structured to move between an open, first position, wherein the movable contact 24 is spaced from the fixed contact 26, and, a closed, second position, wherein the movable contact 24 is directly coupled to, and in electrical communication with, the fixed contact 26. That is, each line bus 22 includes a movable arm 21 that is pivotally coupled to the housing assembly 12. The movable contact 24 is coupled, directly coupled or fixed to an associated movable arm 21.

The number of movable arms 21 are, in an exemplary embodiment, coupled, directly coupled or fixed to a crossbar 25. The crossbar 25 includes an elongated body 27 with a number of cam surfaces 29. A crossbar cam surfaces 29 is structured to engage the second actuator body second end 144, described below. The crossbar 25 is rotatably coupled to the housing assembly 12. The crossbar 25, in an exemplary embodiment, is fixed to each movable arm 21. In this configuration, the crossbar 25 substantially ensures that the movable arm 21, and therefore the movable contacts 24, move at the same time.

Figure 4:
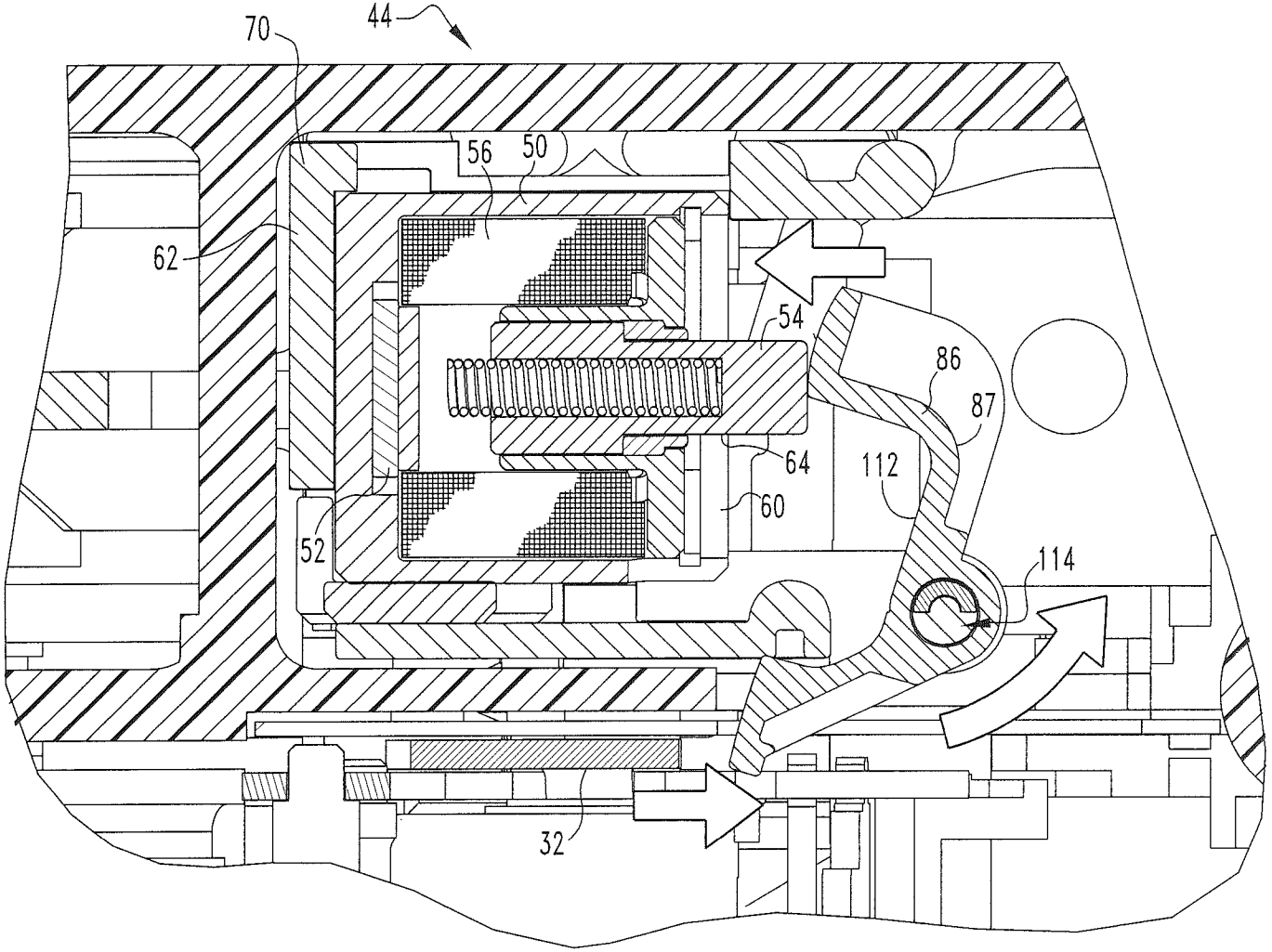
FIG. 4 is a detail cross-sectional top view of a trip and reset assembly.
Figure 5:
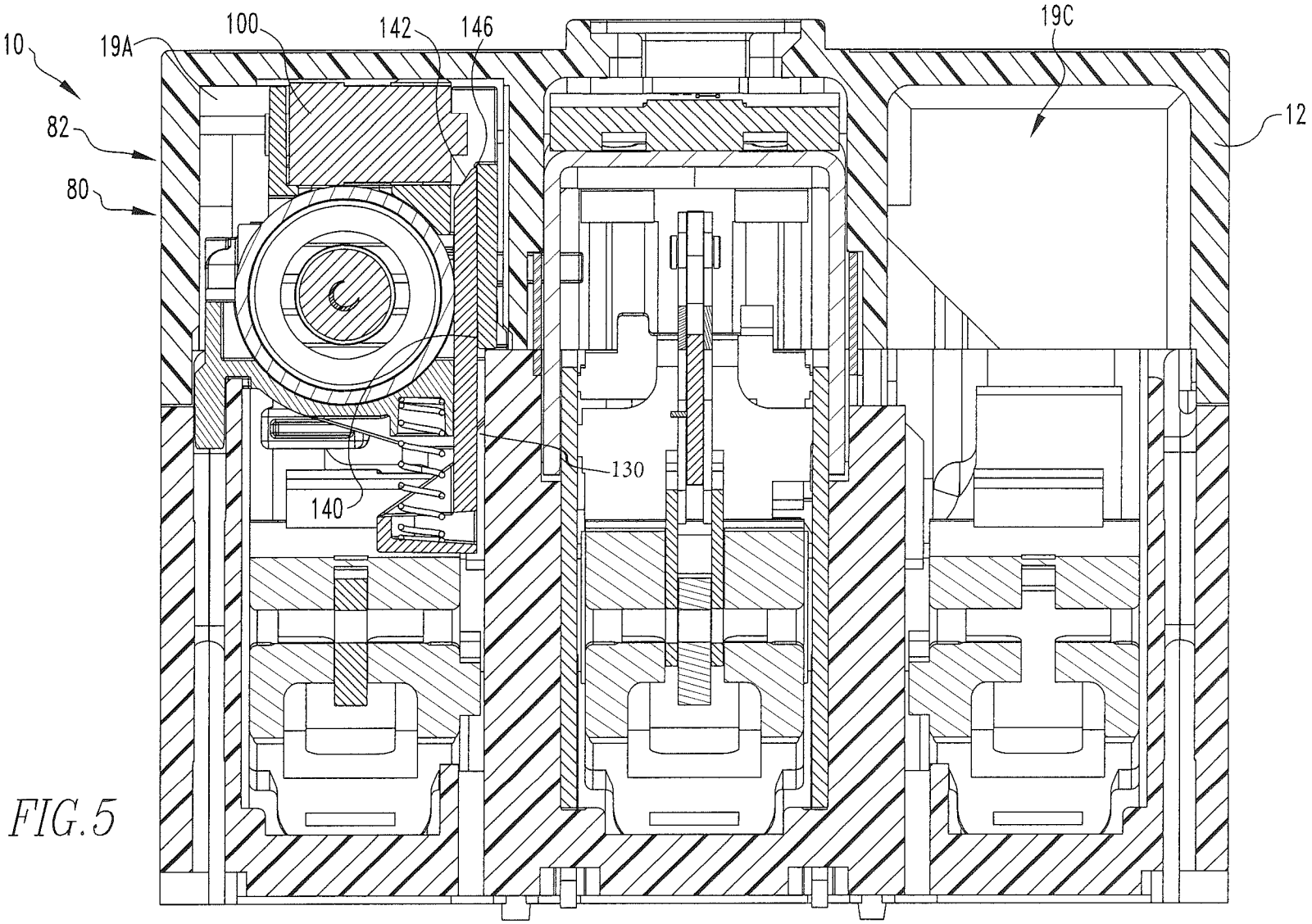
FIG. 5 is a cross-sectional view of an electrical switching apparatus.
Figure 6:
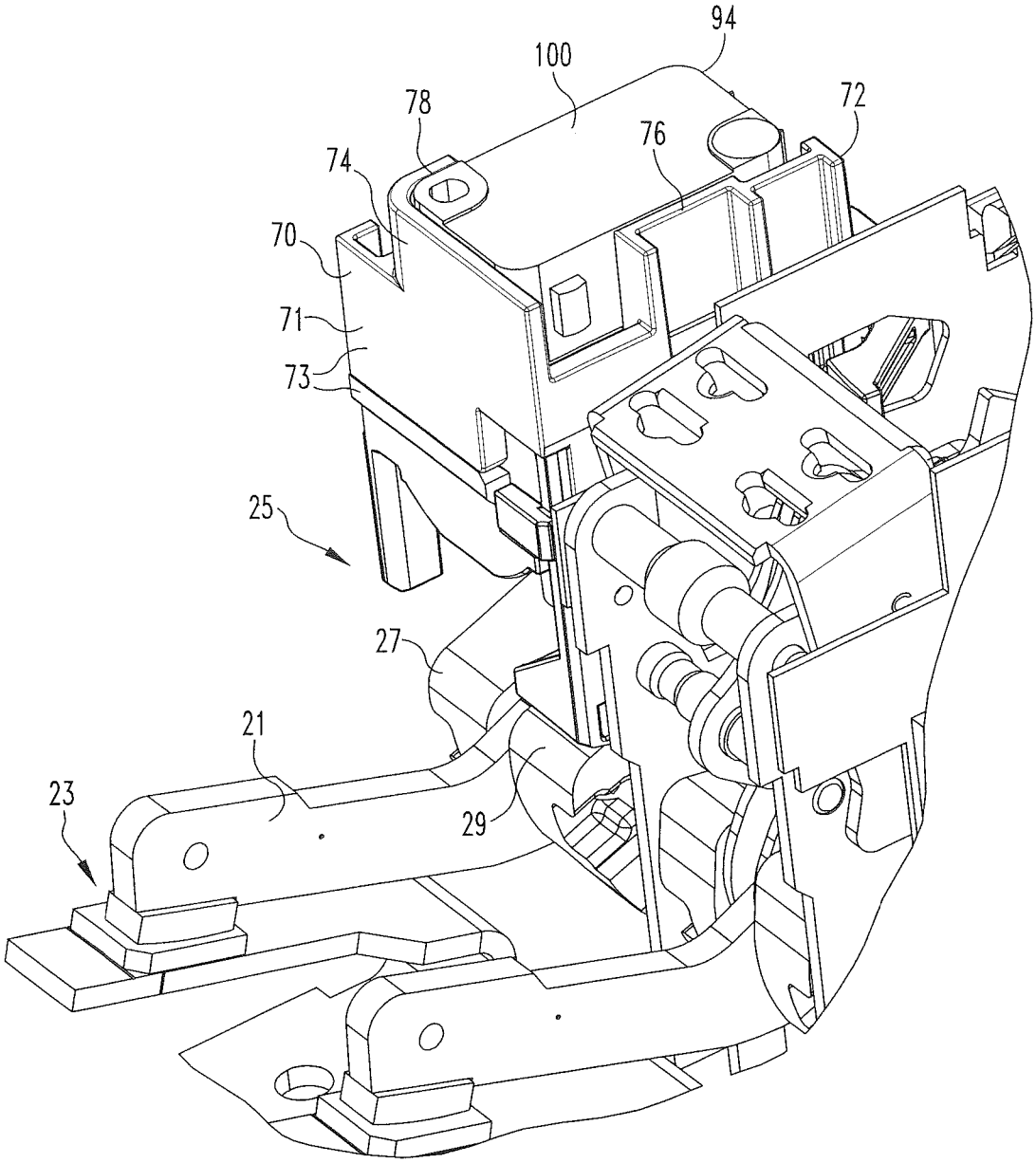
FIG. 6 is a detail isometric view of a multi-purpose mounting assembly in a housing assembly.

The crossbar 25 is part of the operating mechanism 16. Thus, the operating mechanism 16 is operatively coupled to each movable contact 24 and is structured to move each movable contact 24. The operating mechanism 16 moves between a number of configurations including an open, first configuration, wherein each movable contact 24 is spaced from an associated fixed contact 26, and, a closed, second configuration, wherein each movable contact 24 is directly coupled to, and in electrical communication with, the associated fixed contact 26. The operating mechanism 16 includes biasing elements (not shown) such as, but not limited to springs (not shown), that bias the operating mechanism 16 to the first configuration. Thus, the contacts 24, 26 are biased to the open, first position. The operating mechanism 16 includes a handle 30 and a reset member 32 (FIG. 4). The handle 30 may be used to move the contacts 24, 26 between the first and second positions. The handle 30 may also be moved to a reset position, thereby moving the operating mechanism 16 into a reset configuration. In an exemplary embodiment, the reset member 32 moves with the handle 30 and engages the trip and reset assembly 111 as described below.

The operating mechanism 16 further includes a catch (not shown), or similar device, that selectively prevents the operating mechanism 16 from moving to the first configuration. Thus, when the operating mechanism 16 is in the second configuration, wherein the pair of contacts 23 are in the closed position, the catch maintains the contacts 23 in the closed, second position. The catch, or more generally the operating mechanism 16 is mechanically coupled to the trip unit assembly 40, described below, by a trip latch (not shown). That is, the catch engages the trip latch. When the trip unit assembly 40 detects an over-current condition, a mechanical linkage causes the catch to be released from the trip latch thereby allowing the bias of the operating mechanism 16 to move the contacts 24, 26 to the open, first position. As is known, when the operating mechanism 16 is moved into the reset configuration, the catch reengages the trip latch before the operating mechanism 16 moves into the second position.

As shown in FIGS. 1-4, the trip unit assembly 40 includes a number of components such as, but not limited to, a number of electrical buses 42 (shown schematically), a trip unit actuator assembly 44, a trip circuit 46, a trip bar 48, a multi-purpose mounting assembly 70, and a trip and reset assembly 111. As is known, the trip circuit 46 is structured to detect an over-current condition in any of the trip unit electrical buses 42. The trip circuit 46 produces an electronic signal upon detecting an over-current condition in the conductor assembly 14. The trip unit actuator assembly 44 is an electro-mechanical device that is in electronic communication with the trip circuit 46 and which is structured to produce a mechanical motion in response to receiving a signal indication and over-current condition in the conductor assembly 14, as described below.

The trip bar 48 includes an elongated body 47. The longitudinal axis of the trip bar body 47 is also an axis of rotation. The trip bar 48 is movably coupled and, in an exemplary embodiment, rotatably coupled to the electrical switching apparatus housing assembly 12. The trip bar body 47 includes a number of engagement surfaces 45 including, but not limited to, radial extensions 49. As noted above, the trip bar 48 is operatively coupled to the operating mechanism 16 so that rotation of the trip bar 48 causes the operating mechanism 16 to move from the operating mechanism 16 second configuration to the operating mechanism 16 first configuration. That is, the trip bar 48 moves between a number of positions including a trip bar first position, wherein the catch does not engage the trip latch allowing the operating mechanism 16 to move to the operating mechanism 16 first configuration, and a trip bar second position, wherein the catch engages the trip latch thereby maintaining the operating mechanism 16 in the operating mechanism 16 second configuration.

The trip circuit 46 (shown schematically) is disposed in the electrical switching apparatus housing assembly 12 and coupled to the conductive elements 20 so as to detect an over-current condition, as is known. The trip circuit 46 is coupled to, and in electronic communication with the trip unit actuator assembly 44 via the number of trip unit electrical buses 42. Thus, the entire trip unit assembly 40 is disposed within the electrical switching apparatus housing assembly 12.

The trip unit actuator assembly 44 is structured to be actuated in response to receiving an electronic signal from the trip circuit 46. That is, the trip unit actuator assembly 44 is structured to receive an electronic signal from the trip circuit 46 and, in response thereto, to actuate a plunger 54 as described below. In an exemplary embodiment, the trip unit actuator assembly 44 is a flux shunt trip actuator that includes a housing 50, a permanent magnet 52, an elongated actuator member or plunger 54, a coil 56 and an energizing circuit 58 (shown schematically). The trip unit actuator assembly housing 50 includes a first end 60 and a second end 62. The trip unit actuator assembly housing second end 62 includes an opening 64 corresponding to the cross-sectional shape of the plunger 54. The permanent magnet 52 is disposed in the trip unit actuator assembly housing 50 at the trip unit actuator assembly housing first end 60. The plunger 54 is movably disposed in the trip unit actuator assembly housing 50 and moves axially between a plunger first, extended position, wherein the plunger 54 engages the trip bar 48 and moves the trip bar 48 into the trip bar first position, and a plunger second, retracted position, wherein the plunger 54 is spaced from the trip bar 48. A portion, or end, of the plunger 54 extends through the trip unit actuator assembly housing second end opening 64. The plunger 54 is made from a magnetically sensitive material, e.g., a ferrous material or a magnetic material. Thus, when the plunger 54 is in the plunger first position it is operatively spaced from the permanent magnet 52. That is, when the plunger 54 is in the first position, the permanent magnet 52 does not have sufficient force to attract, i.e., cause movement the plunger 54. When the plunger 54 is in the plunger second position, the plunger 54 is not operatively spaced from the permanent magnet 52. That is, when the plunger 54 is in the second position, the permanent magnet 52 has sufficient force to attract the plunger 54; thus, the plunger 54 is maintained in the plunger second position.

The coil 56 is disposed in the trip unit actuator assembly housing 50 and disposed about the plunger 54. The coil 56 is, in an exemplary embodiment, energized by the energizing circuit 58 and thereby creates a magnetic field. That is, the energizing circuit 58 is coupled to, and in electrical communication with, the coil 56. The magnetic field created by the coil 56 is sufficiently strong to overcome the magnetic attraction between the permanent magnet 52 and the plunger 54. Thus, when the coil 56 is energized, the plunger 54 moves to the first position. It is noted that in the first position, the plunger 54 is beyond the range of the permanent magnet 52. That is, the plunger 54 is more than operatively spaced from the permanent magnet 52. Thus, when the plunger 54 moves to the first position, it remains there until acted upon by an external force. Further, it is noted that because of the configuration of the trip and reset assembly 111, described below, the energy required to energize the coil 56 is reduced relative to other trip and reset configurations. Further, it is noted that because of the configuration of the trip and reset assembly 111, described below, the energy required to energize the coil 56 is reduced relative to other trip and reset configurations.

That is, the energizing circuit 58 charges a capacitor to a regulated voltage determined by circuit components (none shown). The value of the regulated voltage stored by the capacitor is determined by the voltage needed by the trip unit actuator assembly 44 in order to trip the circuit breaker 10. Harvesting technology has a limited ability to charge the capacitor to the proper voltage that is required by known trip unit actuator assemblies. Therefore, the trip unit actuator assembly 44 is structured to trip at a much lower voltage than previous trip unit actuator assemblies. For example, known trip unit actuators required the capacitor to be charged to about 41 volts. In an exemplary embodiment, the trip unit actuator assembly 44 is structured to trip at a capacitor charge of between about 22 volts and 28 volts, or about 25 volts.

As shown in FIGS. 5-8, the multi-purpose mounting assembly 70 includes a body 71 having a first end 72, an opposing second end 74 a first lateral side 76 and a second lateral side 78. As shown, the multi-purpose mounting assembly 70 is separate from the electrical switching apparatus housing assembly 12. Further, as shown, the multi-purpose mounting assembly body 71 includes a number of components 73 that are coupled to form the multi-purpose mounting assembly 70. In an alternate embodiment, not shown, the trip unit assembly multi-purpose mounting assembly 70, or a portion thereof, is unitary with the electrical switching apparatus housing assembly 12.

Figure 7:
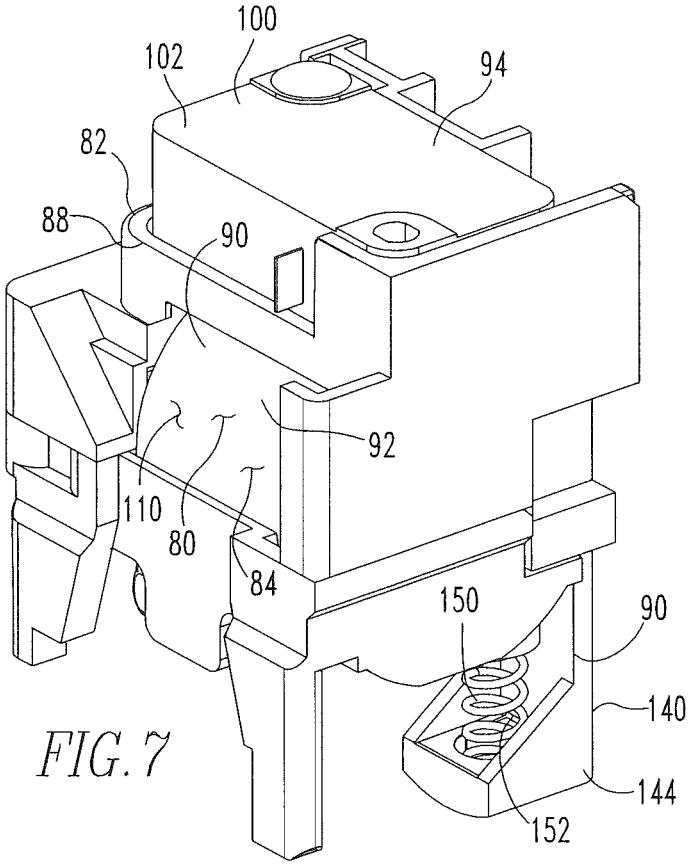
FIG. 7 is an isometric view of a multi-purpose mounting assembly.
Figure 8:
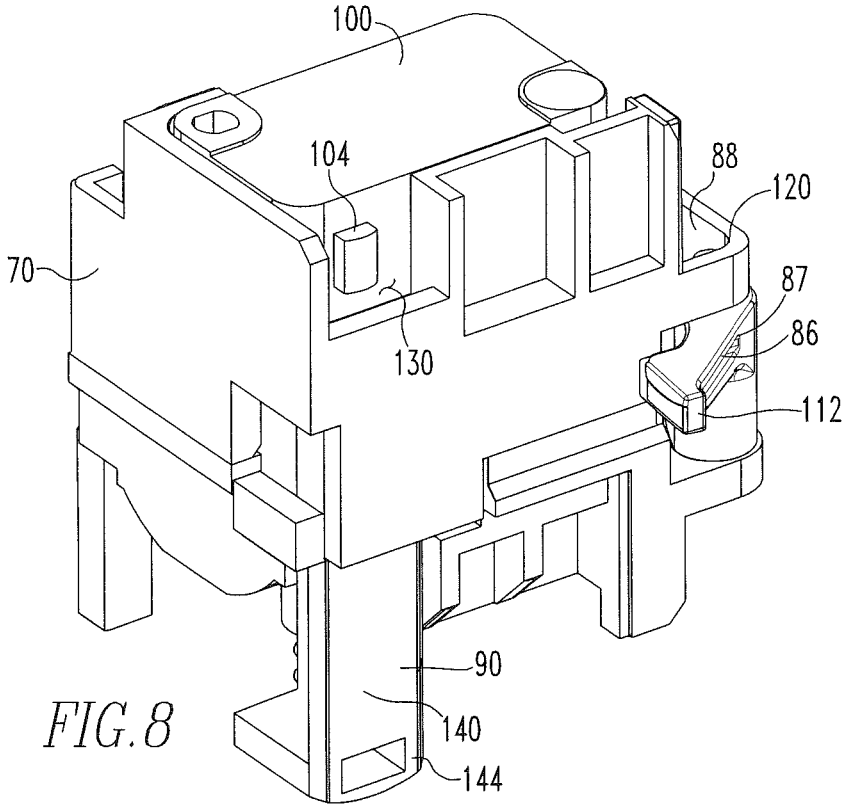
FIG. 8 is another isometric view of a multi-purpose mounting assembly.

The multi-purpose mounting assembly body 71 defines a first mounting assembly 80 and a second mounting assembly 82. As shown in FIGS. 7 and 8, the first mounting assembly 80 includes a first mounting construct 84 and a first actuator 86. The second mounting assembly 82 includes a second mounting construct 88 and a second actuator 90. The first mounting construct 84 is structured to support a first electrical component 92. The second mounting construct 88 is structured to support a second electrical component 94. The multi-purpose mounting assembly body 71 has a width sized to be disposed in a single housing assembly cavity 19A (as shown).

In an exemplary embodiment, the first and second electrical components 92, 94 are different from each other. That is, in an exemplary embodiment, the first electrical component 92 is the trip unit actuator assembly 44, described above. Further, the second electrical component 94 is an auxiliary switch 100. The auxiliary switch 100, in an exemplary embodiment, includes a generally parallelepiped body 102 and an actuator button 104. The auxiliary switch button 104 moves between an extended, first position and a retracted, second position. The auxiliary switch 100 is, in an exemplary embodiment, closed when the auxiliary switch button 104 moves into the second position.

Figure 3:
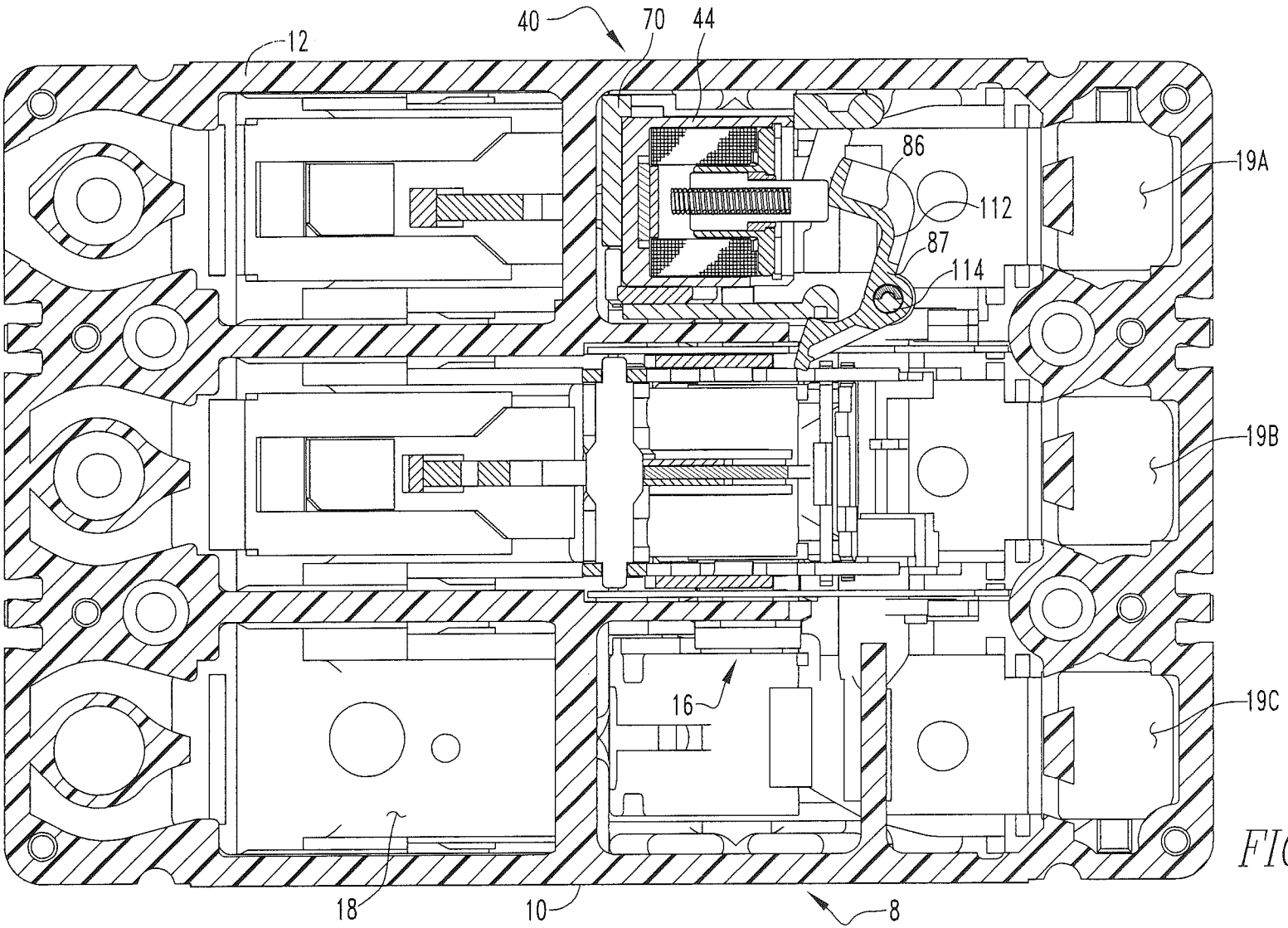
FIG. 3 is a cross-sectional top view of an electrical switching apparatus.

In an exemplary embodiment, the first mounting construct 84 includes a cavity 110 that generally corresponds with the size and shape of the trip unit actuator assembly 44. The first mounting construct 84 defines an opening 113 into the cavity that is sized to allow the plunger 54 to pass therethrough. Further, the first mounting construct 84 is structured to movably support the first actuator 86. That is, in an exemplary embodiment, the first actuator 86 is a trip and reset assembly actuator 112. The trip and reset assembly 111 includes the actuator 112 and an actuator mounting 114 (FIG. 3). The first actuator 86 includes an elongated body 87 that is structured to actuate, and in this embodiment reset, the first electrical component 92. That is, as used herein, "actuate" includes resetting an electrical component. In an exemplary embodiment, the first actuator 86 is movably, or pivotally, coupled to the mounting assembly body 71 at the actuator mounting 114. During a reset operation, the first actuator 86 is structured to move the plunger 54 from the second position to the first position. That is, the actuator mounting 114 is a pivotal coupling and the first actuator 86 is structured to move between a first position, wherein the first actuator 86 does not engage the plunger 54 and a second position wherein the first actuator 86 engages the plunger 54.

In an exemplary embodiment, the second mounting construct 88 includes a platform 120 structured to support the auxiliary switch 100. Further, the second mounting construct 88 is structured to movably support the second actuator 90. In an exemplary embodiment, the mounting assembly body 71 defines a passage 130 with a generally rectangular cross-sectional shape. The passage 130 is disposed adjacent the platform 120. The second actuator 90 includes a generally planar body 140 with a generally rectangular cross-sectional shape corresponding to the passage 130. The second actuator body 140 further includes a first end 142 and a second end 144. In an exemplary embodiment, the second actuator body first end 142 is tapered and includes an angled face 146. The second actuator body second end 144 is structured to be engaged by the contact arm crossbar 25, or a crossbar cam surface 29.

The second actuator 90 is movably, i.e., slidably, disposed in the passage 130 with the second actuator body first end angled face 146 oriented and positioned to engage the auxiliary switch button 104. The second actuator 90 is structured to move longitudinally in the passage 130. That is, the second actuator 90 is structured to move between a first position, wherein the second actuator 90 engages the auxiliary switch button 104 and a second position, wherein the second actuator 90 does not engage the auxiliary switch button 104. The second actuator body 140 cannot rotate in the passage 130 and, as such, the second actuator body first end angled face 146 remains oriented and positioned to engage the auxiliary switch button 104. In an exemplary embodiment, the second mounting construct 88 also includes a biasing device 150 (FIG. 7) such as, but not limited to, a compression spring 152. The biasing device 150 is coupled to the second actuator 90 and biases the second actuator 90 toward the second position.

The multi-purpose mounting assembly 70 is assembled as follows. The first electrical component 92 (trip unit actuator assembly 44) is generally disposed within the first mounting construct 84, i.e., within the cavity 110, with the plunger 54 aligned with the opening 113. The first actuator 86 is movably, and in an exemplary embodiment, pivotally coupled to the mounting assembly body 71. The first actuator 86 is further structured to engage the trip bar 48 when the multi-purpose mounting assembly 70 is disposed in a cavity 19A (as shown). The second electrical component 94 (auxiliary switch 100) is disposed on the second mounting construct 88, i.e., platform 120, with the auxiliary switch button 104 disposed adjacent the second actuator 90.

The multi-purpose mounting assembly 70 is then disposed in the housing assembly and, as shown, in a single cavity 19A. Initially, the first and second actuators 86, 90 are in their second positions. In this configuration, the first actuator 86 engages, or is structured to engage, the trip bar 48. That is, when the trip unit actuator assembly 44 receives an electronic signal from the trip circuit 46 and actuates plunger 54, plunger 54 engages the first actuator 86. As the first actuator 86 moves into the first position, the first actuator 86 engages the trip bar 48 causing the operating mechanism 16 to move into the first position and separate the contacts 23. As the contacts 23 separate, the crossbar 25 rotates causing crossbar cam surface 29 to engage the second actuator body second end 144 causing the second actuator 90 to move from the second position to the first. As the second actuator 90 moves from the second position to the first, the second actuator body first end 142, and angled face 146, engage the auxiliary switch button 104. Further, during a reset operation, as detailed in U.S. patent application Ser. No. 14/103,871, the first actuator 86 engages the plunger 54 and moves the plunger 54 to its first position.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

Further, as used herein, any element initially identified in a claim's preamble is not a claim element even if such element is later recited in the claim. That is, the claims may recite a number of unclaimed elements in the preamble and later recite a relationship or an interaction between the unclaimed elements set forth in the preamble and the claimed elements. It is understood that even though the elements initially recited in the preamble are later recited in the body of the claim, those elements, i.e., the unclaimed elements identified in the preamble, are not claimed elements. For example, a claim for the trip and reset assembly 111 only claims the elements of the trip and reset assembly 111; the claim preamble, however, identifies a number of elements, such as but not limited to the operating mechanism 16. It is understood that a claim recitation describing the interaction of the trip and reset assembly 111 with the operating mechanism 16, i.e., the unclaimed elements identified in the preamble, does not claim the unclaimed elements identified in the preamble which, in this example, are the elements of the operating mechanism 16.

What is claimed is:

1. A multi-purpose mounting assembly structured to be disposed in an electrical switching apparatus housing assembly, said multi-purpose mounting assembly comprising:

a body defining a first mounting assembly and a second mounting assembly;

said first mounting assembly including a first mounting construct;

said second mounting assembly including a second mounting construct;

said first mounting construct structured to support a first electrical component;

said second mounting construct structured to support a second electrical component;

said first mounting assembly further includes a first actuator;

said second mounting assembly further includes a second actuator;

said first mounting construct structured to movably support said first actuator;

said first actuator structured to actuate said first electrical component;

said second mounting construct structured to movably support said second actuator;

said second actuator structured to actuate said second electrical component; and wherein said electrical switching apparatus housing assembly defines a number of cavities wherein each cavity has a width, and, wherein said multi-purpose mounting assembly body has a width sized to be disposed in a single cavity.

2. A multi-purpose mounting assembly structured to be disposed in an electrical switching apparatus housing assembly, said multi-purpose mounting assembly comprising:

a body defining a first mounting assembly and a second mounting assembly;

said first mounting assembly including a first mounting construct;

said second mounting assembly including a second mounting construct;

said first mounting construct structured to support a first electrical component;

said second mounting construct structured to support a second electrical component;

said first mounting assembly further includes a first actuator;

said second mounting assembly further includes a second actuator;

said first mounting construct structured to movably support said first actuator;

said first actuator structured to actuate said first electrical component;

said second mounting construct structured to movably support said second actuator;

said second actuator structured to actuate said second electrical component;

wherein said first mounting construct is a cavity structured to generally enclose said first electrical component; and said second mounting construct is a platform structured to support said second electrical component.

3. A multi-purpose mounting assembly structured to be disposed in an electrical switching apparatus housing assembly, said multi-purpose mounting assembly comprising:

a body defining a first mounting assembly and a second mounting assembly;

said first mounting assembly including a first mounting construct;

said second mounting assembly including a second mounting construct;

said first mounting construct structured to support a first electrical component;

said second mounting construct structured to support a second electrical component;

said first mounting construct is a cavity structured to generally enclose a trip unit actuator assembly;

said second mounting construct is a platform structured to support an auxiliary switch;

said first mounting assembly further includes a first actuator;

said second mounting assembly further includes a second actuator;

said trip unit actuator assembly includes an elongated plunger structured to move longitudinally between an extended, first position and a retracted, second position;

said first actuator structured to move between a first position, wherein said first actuator does not engage said plunger and a second position wherein said first actuator engages said plunger;

said auxiliary switch includes a button structured to move between an extended, first position and a retracted, second position; and said second actuator structured to move between a first position, wherein said second actuator does not engage said auxiliary switch button and a second position wherein said second actuator engages said auxiliary switch button.

4. The multi-purpose mounting assembly of claim 3 wherein:

said first actuator is pivotally coupled to said mounting assembly body;

said second actuator includes an elongated body structured to move longitudinally; and said second actuator is slidably coupled to said mounting assembly body.

5. The multi-purpose mounting assembly of claim 4 wherein:

said second mounting assembly further includes a biasing device;

said biasing device coupled to said second actuator; and said biasing device biasing said second actuator to said first position.

6. The multi-purpose mounting assembly of claim 4 wherein:

said second actuator body is a generally planar body with a generally rectangular cross-sectional shape; and said second mounting construct includes a passage with a generally rectangular cross-sectional shape.

7. The multi-purpose mounting assembly of claim 4 wherein said electrical switching apparatus includes a contact arm crossbar and wherein:

said second actuator body includes a first end and a second end;

wherein said second actuator body first end is tapered and includes an angled face;

said second actuator body first end angled face oriented and positioned to engage said auxiliary switch button when said second actuator is in said second position; and wherein said second actuator body second end is structured to be engaged by said contact arm crossbar.

8. An electrical switching apparatus comprising:

a housing assembly defining a number of cavities, each cavity having a width;

a number of fixed contacts and a number of movable contacts, said fixed and movable contacts disposed in said housing assembly, wherein each said movable contact is movable between an open, first position, wherein the movable contact is spaced from a fixed contact, and, a closed, second position, wherein the movable contact is directly coupled to, and in electrical communication with, a fixed contact;

an operating mechanism including a crossbar, said operating mechanism operatively coupled to each movable contact and structured to move each movable contact, wherein each said movable contact is movable between an open, first position, wherein the movable contact is spaced from a fixed contact, and, a closed, second position, wherein the movable contact is directly coupled to, and in electrical communication with, a fixed contact;

a multi-purpose mounting assembly including a body defining a first mounting assembly and a second mounting assembly;

said first mounting assembly including a first mounting construct;

said second mounting assembly including a second mounting construct;

said first mounting construct structured to support a first electrical component;

said second mounting construct structured to support a second electrical component;

said first mounting assembly further includes a first actuator;

said second mounting assembly further includes a second actuator;

said first mounting construct structured to movably support said first actuator;

said first actuator structured to actuate said first electrical component;

said second mounting construct structured to movably support said second actuator; and said second actuator structured to actuate said second electrical component.

9. The electrical switching apparatus of claim 8 wherein said first and second electrical components are different.

10. The electrical switching apparatus of claim 8 wherein said electrical switching apparatus housing assembly defines a number of cavities wherein each cavity has a width, and, wherein said multi-purpose mounting assembly body has a width sized to be disposed in a single cavity.

11. The electrical switching apparatus of claim 8 wherein:

said first mounting construct is a cavity structured to generally enclose said first electrical component; and said second mounting construct is a platform structured to support said second electrical component.

12. An electrical switching apparatus comprising:

a housing assembly defining a number of cavities, each cavity having a width;

a number of fixed contacts and a number of movable contacts, said fixed and movable contacts disposed in said housing assembly, wherein each said movable contact is movable between an open, first position, wherein the movable contact is spaced from a fixed contact, and, a closed, second position, wherein the movable contact is directly coupled to, and in electrical communication with, a fixed contact;

an operating mechanism including a crossbar, said operating mechanism operatively coupled to each movable contact and structured to move each movable contact, wherein each said movable contact is movable between an open, first position, wherein the movable contact is spaced from a fixed contact, and, a closed, second position, wherein the movable contact is directly coupled to, and in electrical communication with, a fixed contact;

a multi-purpose mounting assembly including a body defining a first mounting assembly and a second mounting assembly;

said first mounting assembly including a first mounting construct;

said second mounting assembly including a second mounting construct;

said first mounting construct structured to support a first electrical component;

said second mounting construct structured to support a second electrical component;

said first mounting construct is a cavity structured to generally enclose a trip unit actuator assembly;

said second mounting construct is a platform structured to support an auxiliary switch;

said trip unit actuator assembly includes an elongated plunger structured to move longitudinally between an extended, first position and a retracted, second position;

a first actuator structured to move between a first position, wherein said first actuator does not engage said plunger and a second position wherein said first actuator engages said plunger;

said auxiliary switch includes a button structured to move between an extended, first position and a retracted, second position; and a second actuator structured to move between a first position, wherein said second actuator does not engage said auxiliary switch button and a second position wherein said second actuator engages said auxiliary switch button.

13. The electrical switching apparatus of claim 12 wherein:

said first actuator is pivotally coupled to said mounting assembly body;

said second actuator includes an elongated body structured to move longitudinally; and said second actuator is slidably coupled to said mounting assembly body.

14. The electrical switching apparatus of claim 13 wherein:

said second mounting assembly further includes a biasing device;

said biasing device coupled to said second actuator; and said biasing device biasing said second actuator to said first position.

15. The electrical switching apparatus of claim 13 wherein said electrical switching apparatus includes a contact arm crossbar and wherein:

said second actuator body includes a first end and a second end;

wherein said second actuator body first end is tapered and includes an angled face;

said second actuator body first end angled face oriented and positioned to engage said auxiliary switch button when said second actuator is in said second position; and wherein said second actuator body second end is structured to be engaged by said contact arm crossbar.

16. The electrical switching apparatus of claim 13 wherein:

said second actuator body is a generally planar body with a generally rectangular cross-sectional shape; and said second mounting construct includes a passage with a generally rectangular cross-sectional shape.

* * * * *